US007784861B1

(12) United States Patent
Deng

(10) Patent No.: US 7,784,861 B1
(45) Date of Patent: Aug. 31, 2010

(54) FOLDING FRAME FOR A FOLDING CHAIR WITH SEAT BACK AND SEAT COVER

(76) Inventor: Jianrong Deng, Room 401 Bihuge Shaminan Xincheng, Huanggi Dist., Nanhai City, Guang Dong Province (CN) 528248

( * ) Notice: Subject to any disclaimer, the term of this patent is extended or adjusted under 35 U.S.C. 154(b) by 0 days.

(21) Appl. No.: 12/661,982

(22) Filed: Mar. 29, 2010

Related U.S. Application Data

(62) Division of application No. 12/000,206, filed on Dec. 11, 2007, now Pat. No. 7,717,502.

(51) Int. Cl.
*A47C 4/00* (2006.01)
*A47C 4/28* (2006.01)

(52) U.S. Cl. ..... 297/23; 297/16.1; 297/16.2; 297/35; 297/38; 297/39; 297/41; 297/42; 297/45; 297/46; 297/47; 297/55; 297/56; 297/58

(58) Field of Classification Search ..... 297/23, 297/45, 55, 58, 16.1, 16.2, 35, 38, 39, 41, 297/42, 46, 47, 56
See application file for complete search history.

(56) References Cited

U.S. PATENT DOCUMENTS 1,568,244 A * 1/1926 Rosenkranz ..... 297/56
1,608,911 A * 11/1926 Smith ..... 297/56 X
1,721,164 A * 7/1929 Newell et al. ..... 297/56
1,815,643 A * 7/1931 Allerding ..... 297/55
1,838,213 A * 12/1931 Buffington ..... 297/55
1,910,539 A * 5/1933 Hambrook et al. ..... 297/57 X
1,949,492 A * 3/1934 Schermerhorn ..... 297/57
2,177,186 A * 10/1939 Nordmark ..... 297/58
2,182,761 A * 12/1939 Johnson ..... 297/56
2,381,574 A * 8/1945 Clarin ..... 297/58
2,649,141 A * 8/1953 Marshall et al. ..... 297/56 X
3,220,764 A * 11/1965 Duer ..... 297/56
4,118,065 A * 10/1978 Watkins ..... 297/45
5,577,799 A * 11/1996 St. Germain ..... 297/35
5,681,078 A * 10/1997 Chen ..... 297/58
5,718,474 A * 2/1998 Kojima et al. ..... 297/58
6,099,073 A * 8/2000 Bruschi ..... 297/58 X
6,206,462 B1 * 3/2001 Huang ..... 297/39
6,361,105 B1 * 3/2002 Turner et al. ..... 297/23
6,517,151 B2 * 2/2003 Liu ..... 297/16.1
6,709,050 B2 * 3/2004 Huang ..... 297/58 X
6,899,384 B1 * 5/2005 Tseng ..... 297/46
6,926,356 B2 * 8/2005 Chen ..... 297/45
6,953,221 B1 * 10/2005 Tseng et al. ..... 297/23
7,014,264 B2 * 3/2006 Alderman et al. ..... 297/55 X
7,017,985 B2 * 3/2006 Chen ..... 297/56
7,052,081 B2 * 5/2006 Leng ..... 297/58
7,070,230 B2 * 7/2006 Chen ..... 297/16.2 X
7,073,852 B1 * 7/2006 Zheng ..... 297/16.2
7,080,877 B1 * 7/2006 Tsai ..... 297/23
7,219,955 B2 * 5/2007 Lu et al. ..... 297/58
7,293,826 B2 * 11/2007 Lu et al. ..... 297/58

(Continued)

*Primary Examiner*—Rodney B White
(74) *Attorney, Agent, or Firm*—Charles I. Brodsky

(57) ABSTRACT

A spring locking knob and a fixed stop at the upper ends of the front legs of a chair frame cooperate to restrict movement of a slideset joining the front legs, rear legs and seat support struts of a chair in making the chair with its cover seat more stable and resistant to an inadvertent folding closure.

7 Claims, 5 Drawing Sheets

U.S. PATENT DOCUMENTS 7,393,050 B2 * 7/2008 Li ..... 297/16.1 X
7,717,502 B2 * 5/2010 Deng ..... 297/23
2002/0171268 A1 * 11/2002 Liu ..... 297/16.1
2002/0175540 A1 * 11/2002 Liu ..... 297/16.1
2003/0234563 A1 * 12/2003 Huang ..... 297/58
2004/0239153 A1 * 12/2004 Leng ..... 297/56
2005/0206202 A1 * 9/2005 Winter et al. ..... 297/23

* cited by examiner

FOLDING FRAME FOR A FOLDING CHAIR WITH SEAT BACK AND SEAT COVER

CROSS-REFERENCE TO RELATED APPLICATIONS

This Application corresponds to one filed Jun. 14, 2006 as PCT/CN/2006/001319.

This Application is a division of application Ser. No. 12/000,206, filed Dec. 11, 2007, now U.S. Pat. No. 7,717,502 B2.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not Applicable

BACKGROUND OF THE INVENTION

1. Field of the Invention

This invention relates to collapsible chairs, in general, and to those provided with a back support, in particular.

2. Description of the Related Art

One of the problems associated with a typical design for a collapsible chair provided with a back is that the chair is not entirely stable, firm and safe. As such, it exhibits a tendency to lose its center of gravity, causing injury to the body. As will become clear from the following description, the collapsible chair of the present invention overcomes such problem.

SUMMARY OF THE INVENTION

As will become clear, the collapsible chair of the first two embodiments of the present invention provides the stability by preventing the chair seat from collapsing upwardly if an extended force is applied downwardly on the rear of the seat, while the third embodiment provides the stability if the extended force is applied upwardly on the front. The center of gravity will be seen to be maintained in each, limiting any possible injury to a person sitting on the chair at such time.

BRIEF DESCRIPTION OF THE DRAWINGS

These and other features of the present invention will be more clearly understood from a consideration of the following description, taken in connection with the accompanying drawings, in which:

FIGS. 2-5 are schematic diagrams helpful in understanding the first embodiment of the invention, in which FIG. 3 shows the structure in its open state, FIG. 4 shows the structure covered with a soft seating overlay, and FIG. 5 shows the structure in its folded, closed state;

FIGS. 6-9 are schematic diagrams helpful in an understanding of the second embodiment of the invention, in which FIG. 7 illustrates the embodiment covered with a soft seat overlay, FIG. 8 shows the embodiment in its half-folded state, and FIG. 9 shows the embodiment completely folded and closed.

DETAILED DESCRIPTION OF THE INVENTION

Figure 1A:
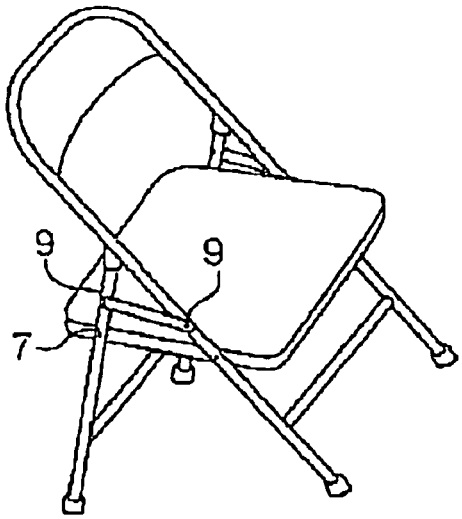
FIG. 1A PRIOR ART
FIGS. 1A and 1B are pictorial drawings of the structure of a typically employed collapsible chair design in which its center of gravity can be lost, as representative of the collapsible chairs with a back typifying the prior art, FIG. 1A showing the chair design in its open position and FIG. 1B showing the chair design as it is being closed.
Figure 1B:
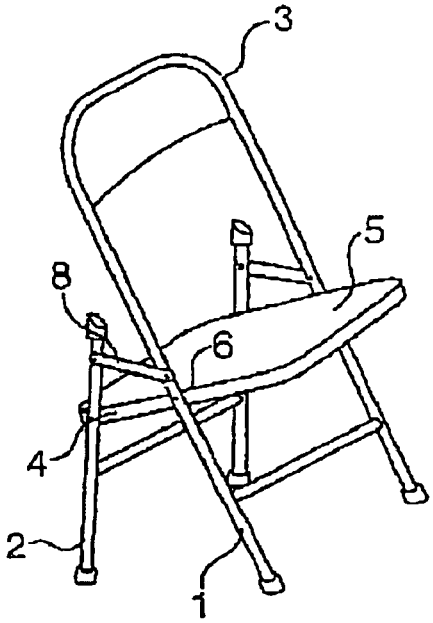
FIG. 1B PRIOR ART
Figure 2:
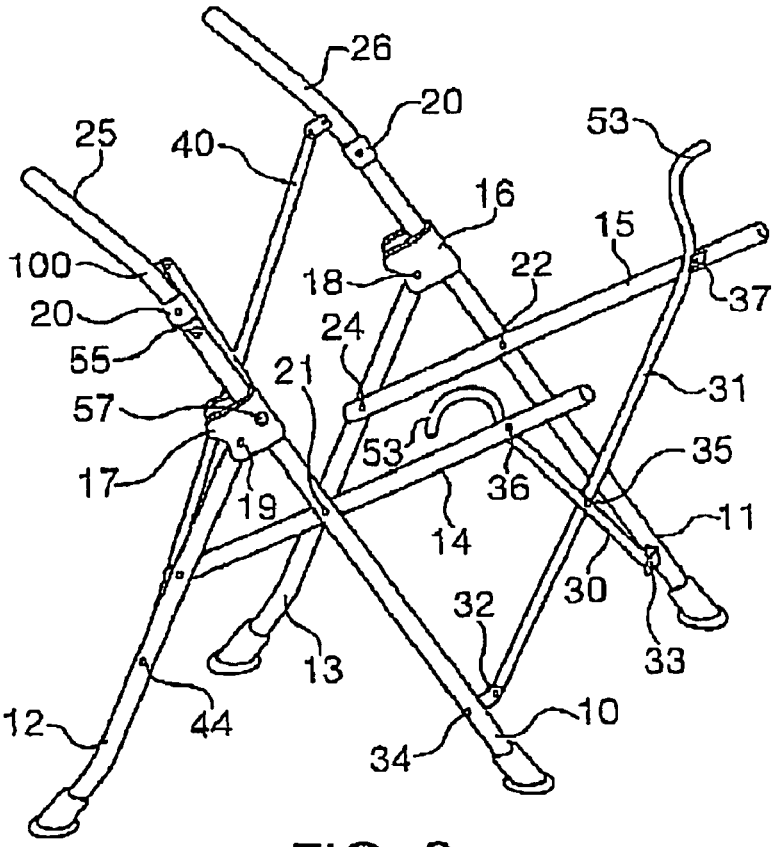
Figure 3:
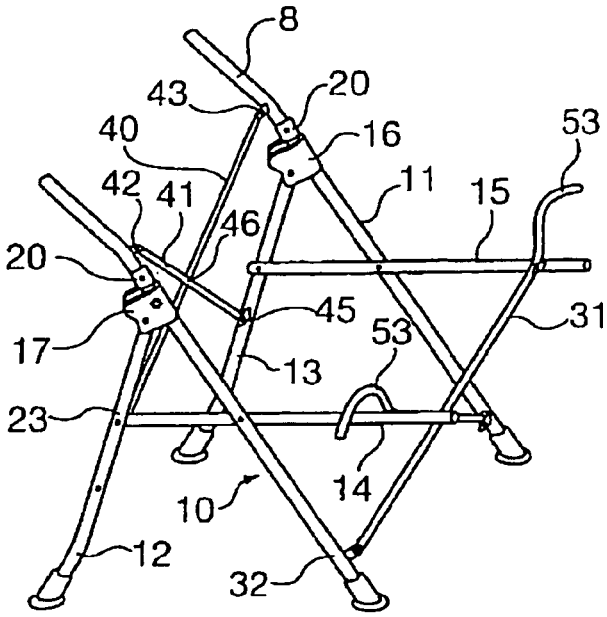
Figure 4:
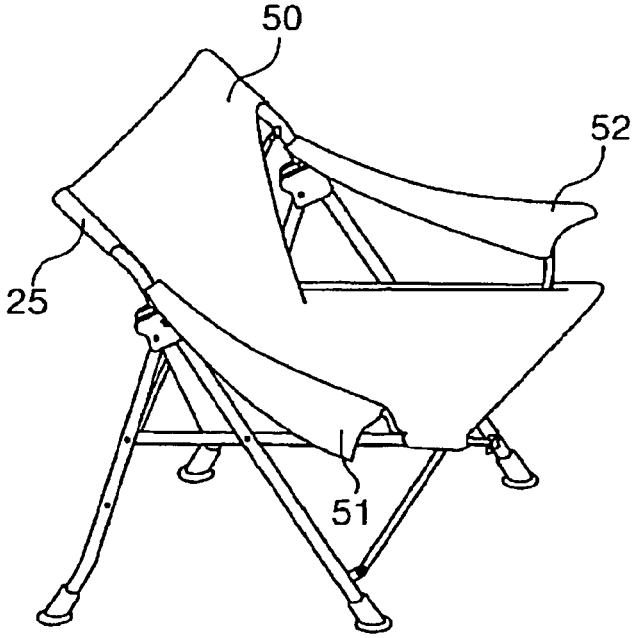

In the prior art collapsible chair design of FIGS. 1A and 1B, it will be noted that the chair is constructed with two inclined front legs 1, and two rear legs 2. The upper sides of the front legs 1 extend rearwardly and upwardly at an oblique angle in forming a support 3 for the back of the chair. The middle of a support 4 for the seat 5 is jointed with the front legs 1 on both sides by a pivot, as at 6. The back of the support 4 is jointed with the rear legs 2 on both sides by a second pivot, as at 7. A connecting plate 8 is included, jointed at both sides with the front legs 1 and rear legs 2, as by a pivot at 9.

When the chair is opened and sat upon, the upper side of the rear legs 2 are intended to sustain pressures produced upon the middle of the front legs 1.

However, experience has shown a deficiency of this construction in that if an extended force is downwardly applied on the back of the seats, the front side of the seat begins to rise so that the entire chair loses its center of gravity. As a result, as the chair begins to close, the connecting plate 4 could easily injure a person sitting on the chair as the chair begins to fold up.

The first two embodiments of the present invention, however, prevent the fold-up from happening. More specifically:

A. In the collapsible chair embodiment of FIGS. 2-5 and 12, a modified construction for the chair is presented. Its two front legs are shown at 10, 11, its two rear legs are shown at 12, 13 and two support struts for a seat frame are shown 14, 15. A pair of sliding brackets, or slidesets 16, 17 are hinged at the upper ends of the rear legs 12, 13, respectively, as by pivots 18, 19, to slide along the upper length of the front legs 10, 11. A fixed bracket or tube 20, is secured to encircle the upper end of each front leg 10, 11 in limiting the upward movements of the slidesets 16, 17 in a manner to be described. The middle parts of the support struts 14, 15 are respectively jointed by pivots with the front legs 10, 11, as at 21, 22. The rear ends of the support struts 14, 15 are similarly pivot connected with the middle of the rear legs 12, 13, as at 23, 24. As will be appreciated, the interconnections between the front legs, the rear legs, and the support struts for the seat form "A" structures on both sides of the chair.

As more clearly shown in FIGS. 2, 3, 5, and 12, the front legs 10, 11 extend rearwardly and upwardly to join with a pair of extender struts 25, 26 for supporting the back of the chair. An overlay exists between the front leg 10 and left extender 25, and between the front leg 11 and right extender 26 so that they may be fitted together and jointed by a pivot coupling through apertures provided on the extenders, as shown at 100 on the left extender 25. A pair of cross support struts 30, 31 are hingeably connected, as at 32, 33 to secure at their lower ends to the front legs 10, 11—for example, as by pivots 34. A second pair of cross support struts 40, 41 are included, hinged at their upper ends to the extenders 25, 26 as by pivots at 42, 43, at their lower ends to the lower portion of the rear legs 12, 13 as at 44, 45 and to each other, midway along their lengths, as at 46.

With the middle of the support struts 30, 31 being pivotally connected together as at 35, and with their upper ends being pivotally connected to the seat support struts 14, 15, as at 36, 37, the front legs 10, 11, the rear legs 12, 13, the support struts 14, 15, and the support struts 40, 41 form two "X" configurations jointed by a hinge in the middle. More specifically, both lower ends of the "X" configurations are jointed with the two front legs, 10, 11 by hinges at 33, 34, and both upper ends of the "X" configurations are jointed with the support struts 14, 15 by the hinges 36, 37.

Such pivot or hinge connections will be understood to allow the middle part of the two front legs 10, 11 and the middle part of the two rear legs 12, 13 to be folded. Both upper ends of the cross support struts 30, 31 are bent and extend outwardly from the pivots 36, 37 at the seat support struts 14, in forming an armrest for a cover for the seat. Such cover is shown at 50 in FIG. 4, with the armrests at 51, 52 to receive the bent extended portions 53 of the support struts 30, 31. The two extenders 25, 26 will be seen from FIG. 4 to also couple with the overlay 50 in providing the seat and back for the chair.

Figure 5:
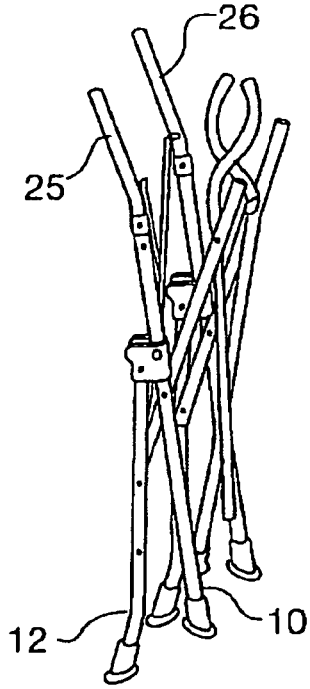
Figure 6:
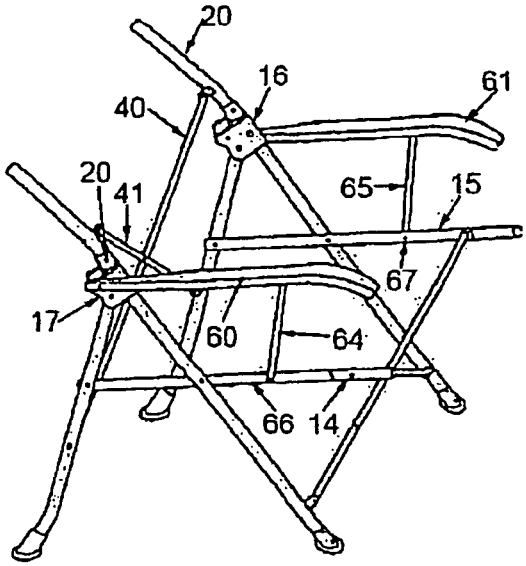

A locking device for the slidesets 16, 17 is provided as it moves along the front legs 10, 11 towards the restrictor tubes 20. The locking device shown in FIGS. 2-5 and 12 includes a spring knob 55 set on each of the front legs 10, 11. A recess is provided on the inside wall of each slideset 16, 17, into which the spring knob 55 is configured to fit. A button 57 on each slideset is used to press the spring knob 55 out from the recess, on the outside wall of the slideset. As will be understood, an extended force exerted downwardly at the rear of cover for the seat is in a direction to collapse or fold the chair because of the various pivot connections, but once the slidesets move to the two restrictors, the spring knobs 55 slide into the recess. This locks up the two slidesets and the front legs 10, 11, so that the slidesets can neither move further upwards nor downwards along the front legs. As a result, the support for the chair becomes more stable. Pressing the buttons 57 to release the spring knobs 55 from the recesses allows the slidesets to be released for sliding down the front legs so that the chair can be folded (FIG. 5).

When the chair according to this embodiment is opened, a soft seating cover 50 can be put in place as previously mentioned. Once the chair is to be stored away, the cover 50 is removed, and the chair can then be folded on a central axis to arrive at the configuration of FIG. 5. With this construction, the various supports are connected together side by side, in sharing the same set of front legs, rear legs and support struts for the seat in their respective pivoted connections. The construction allows the connected support struts to be folded in the central direction in accordance with the described hinged connections.

Figure 7:
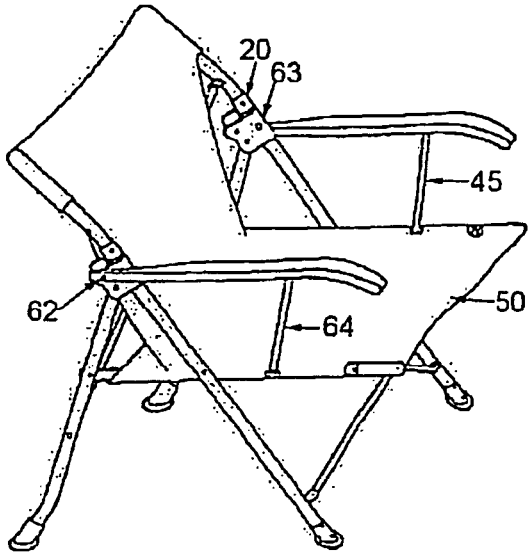
Figure 8:
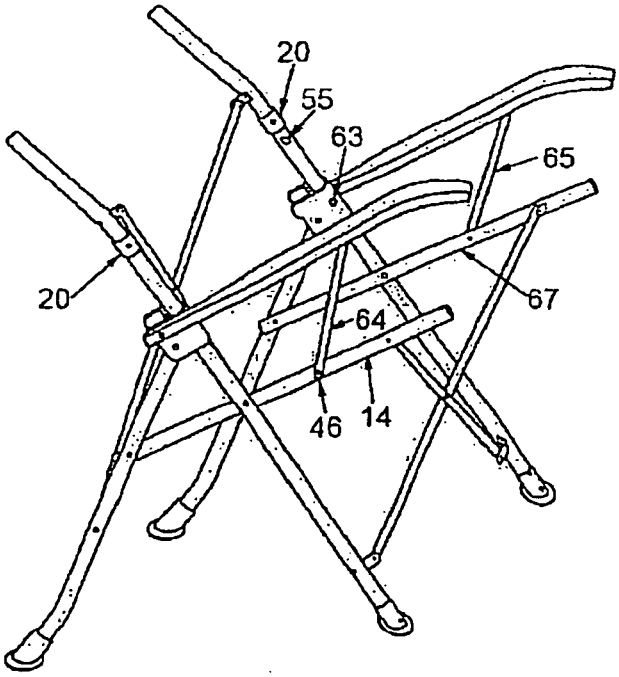
Figure 9:
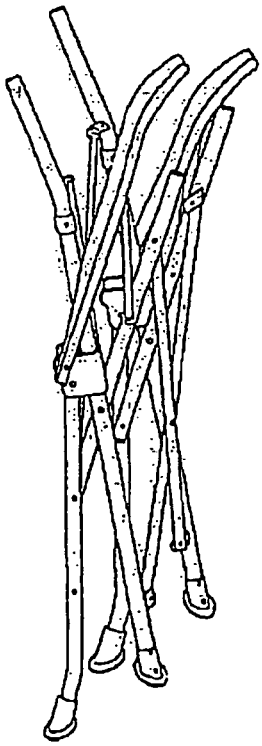

B. The embodiments of FIGS. 6-9 differ from those of FIGS. 2-5 and 12 in the employment of horizontal armrests 60, 61, the back end of which is jointed with the slidesets 16, 17 on the front legs 10, 11 by means of a further pivot or hinge 62, 63. Between the armrests 60, 61 and the seat support struts 14, 15 are support poles or further struts 64, 65 that are joined with the supports 14, 15 by pivots 66, 67. As with the embodiments of FIGS. 2-5 and 12, the two restrictors 20 limit the upward movement of the slidesets 16, 17 to prevent the folding of the chair by an extended force pushing down on the rear of the seat. FIG. 7, once again, shows the soft seating cover 50 in place, while FIG. 8 shows the slidesets moving towards the restrictors 20 where they will eventually be stopped by the spring knob 55.

Figure 10:
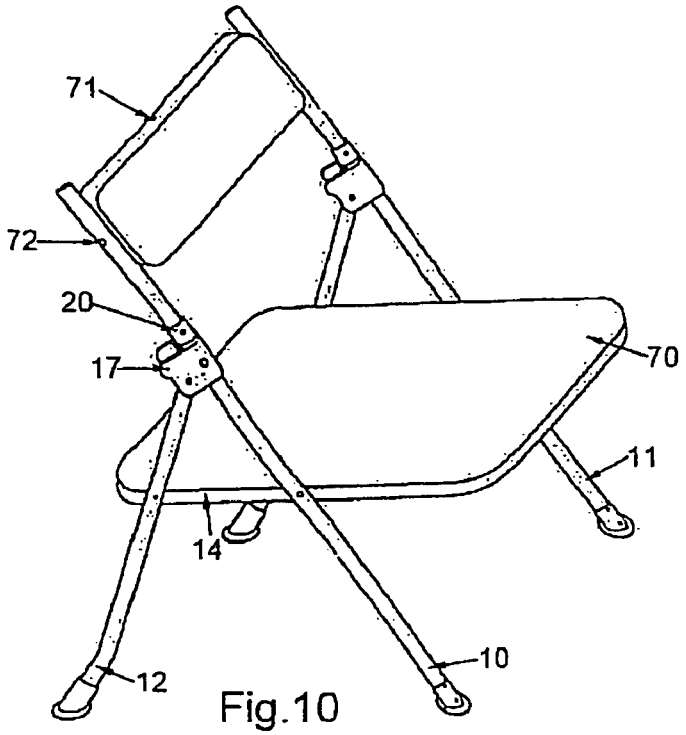
FIG. 10 is a schematic diagram of the third embodiment of the invention, with FIG. 11 showing its structure in its folded, closed state.
Figure 11:
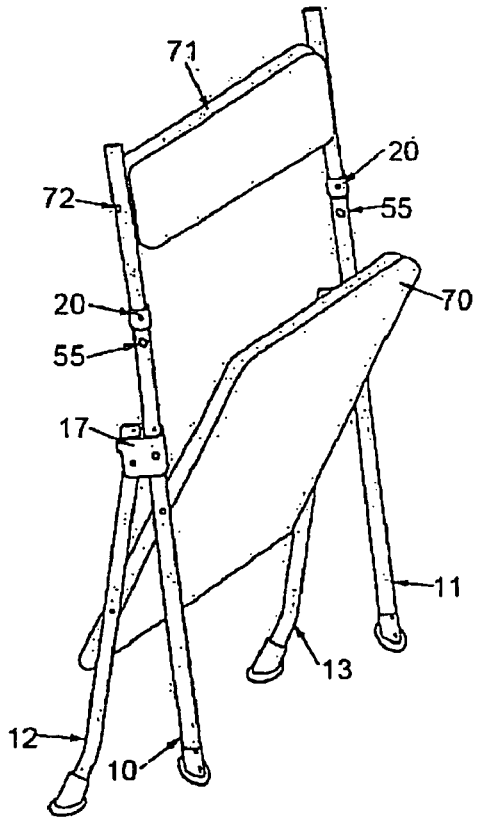
Figure 12:
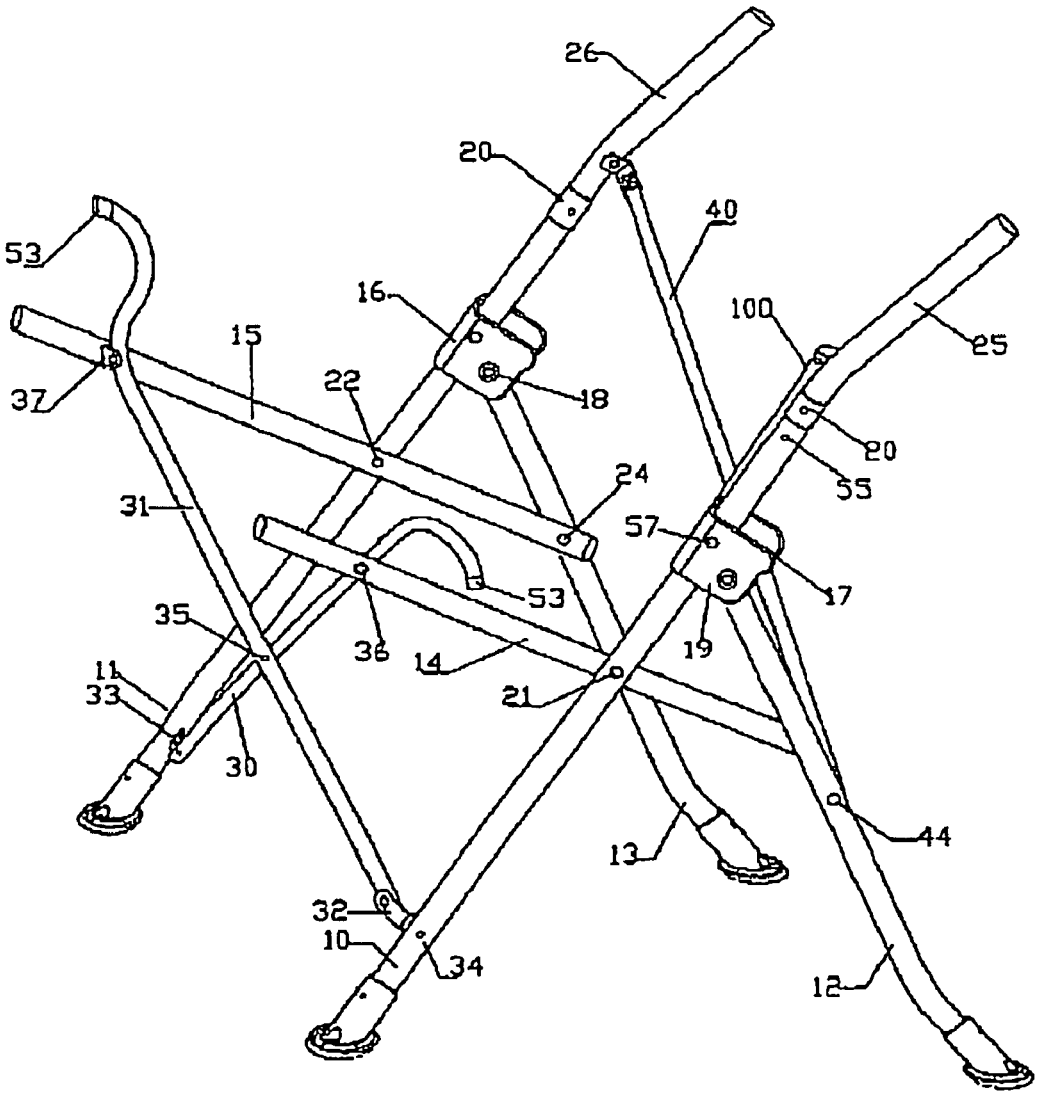
FIG. 12 is a right-side schematic view of the structure of the first embodiment of the invention in its open state, substantially a mirror image of the left-side schematic view of the structure shown in FIG. 3 in its open state.

C. The embodiments of FIGS. 10 and 11 will be appreciated as one where a hard seat 70 is fitted between the two support frame struts 14, 15 of FIGS. 2-9 and 12. Such seat 70 will be appreciated to either serve as a seat for the chair, or act as a supporting device for a seat between the front legs 10 and 11, the rear legs 12, 13 and the support struts 14, 15. A lateral support 71 is connected at the upper ends of the front legs 10, 11 via hinges at 72 on each leg. With this configuration, when the chair of FIGS. 10 and 11 is folded (as by pulling up on the front of the seat or by pushing down on its rear), the front of the support struts 14, 15 rise rearwardly and upwardly. FIG. 11 illustrates that the two front legs and the two rear legs cannot close as tightly together as in the embodiment of FIGS. 2-5 and 12, and in the embodiment of FIGS. 6-9. However, as with those embodiments, the restrictors 20 and spring knobs 55 continue to co-act with the slidesets 16, 17 to limit the fold-up of the chair—but to a point slightly less than fully closed.

While there have been described what are considered to be preferred embodiments of the present invention, it will be readily appreciated by those skilled in the art that modifications can be made without departing from the scope of the teachings herein. For example, although various components of the folding chair of the invention have been described as being in the form of struts, its will be acknowledged that such components could also be in the form of tubes, poles, bars or like metallic members—and the term "struts" is intended to apply to each. For at least such reason, therefore, resort should be had to the claims appended hereto for a true understanding of the scope of the invention.

I claim:

1. In a folding chair, apparatus comprising:

first and second upwardly and rearwardly extending front legs;

first and second upwardly and forwardly extending rear legs;

first and second seat support struts forming a seat support frame;

a first slidable bracket encircling said first front leg above a middle point along the length thereof;

a second slidable bracket encircling said second front leg above a middle point along the length thereof;

a first pivot connection between a midpoint of said first support strut and said middle point of said first front leg;

a second pivot connection between a midpoint of said second support strut and said middle point of said second front leg;

a third pivot connection between a rear point of said first support strut and said middle point of said first rear leg;

a fourth pivot connection between a rear point of said second support strut and said middle point of said second rear leg;

a fifth pivot connection between said first slidable bracket and an upper part of said first rear leg;

a sixth pivot connection between said second slidable bracket and an upper part of said second rear leg;

a first extender strut overlaying said first front leg along said upper part of said first front leg;

a second extender strut overlaying said second front leg along said upper part of said second front leg;

a seventh pivot connection between said first extender strut and said upper part of said first front leg;

an eighth pivot connection between said second extender strut and said upper part of said second front leg;

first and second cross support struts forming a back support frame, with said first cross support being hingeably connected at an upper part to said first extender strut and at a lower part to a lower end of said second rear leg, with said second cross support being hingeably connected at an upper part to said second extender strut and at a lower part to a lower end of said first rear leg, and with said first and second cross support struts being hingeably connected to one another midway along their respective lengths;

a first spring knob between an upper part of said first front leg and said middle point of said first front leg;

a second spring knob between an upper part of said second front leg and said middle part of said second front leg;

a recess in each of said first and second said slidable brackets to capture each of said first and said second spring knobs;

a first fixed bracket encircling said first front leg between said first spring knob and a top part of said first front leg;

a second fixed bracket encircling said second front leg between said second spring knob and a top part of said second front leg;

a first button release on said first slidable bracket to free said first spring knob from capture;

a second button release on said second slidable bracket to free said second spring from capture;

whereby upwards movement of said first slidable bracket, is restricted between said first fixed bracket and said middle point of said first front leg, whereby upward movement of said second slidable bracket is restricted between said second fixed bracket and said middle point of said second front leg, and whereby upwards rotation of said first and said second support struts in a direction folding the chair restricts upward movement of said first slidable bracket at said first fixed bracket and upward movement of said second slidable bracket at said second fixed bracket.

2. The apparatus of claim 1, also including a seat on said seat support frame.

3. The apparatus of claim 1, also including a third and fourth cross support struts, with said third cross support being hingeably connected at an upper part to said first seat support strut and at a lower part to a lower end of said second front leg, with said fourth cross support being hingeably connected at an upper part to said second seat support strut and at a lower part to a lower end of said first front leg, and with said third and fourth cross support struts being hingeably connected to one another midway along their respective lengths.

4. The apparatus of claim 3 wherein each of said third and fourth cross support struts includes a bent portion at respective upper ends thereof.

5. The apparatus of claim 4, also including a soft seat cover coupled between said first and second extender struts and said bent portions of said third and fourth cross support struts.

6. The apparatus of claim 5, additionally including first and second armrests respectively having a first end pivotally connected with each of said first and second slidable brackets.

7. The apparatus of claim 6, further including first and second armrest support struts pivotally connected between each of said armrests and said first and second seat support struts forwardly of midpoints along the lengths of said first and second seat support struts respectively.

* * * * *